US009472843B2

(12) United States Patent
Takeuchi et al.

(10) Patent No.: US 9,472,843 B2
(45) Date of Patent: Oct. 18, 2016

(54) RADIO FREQUENCY GROUNDING SHEET FOR A PHASED ARRAY ANTENNA

(71) Applicant: The Boeing Company, Chicago, IL (US)

(72) Inventors: Jimmy S. Takeuchi, Mercer Island, WA (US); Rodney D. Cameron, Des Moines, WA (US); Peter T. Heisen, Kent, WA (US)

(73) Assignee: The Boeing Company, Chicago, IL (US)

( * ) Notice: Subject to any disclaimer, the term of this patent is extended or adjusted under 35 U.S.C. 154(b) by 797 days.

(21) Appl. No.: 13/757,451

(22) Filed: Feb. 1, 2013

(65) Prior Publication Data

US 2014/0218257 A1 Aug. 7, 2014

(51) Int. Cl.

| | |
|---|---|
| ***H01Q 13/00*** | (2006.01) |
| ***H01Q 1/52*** | (2006.01) |
| ***H01Q 1/38*** | (2006.01) |
| ***H01Q 3/26*** | (2006.01) |
| ***H01Q 21/00*** | (2006.01) |
| ***H01Q 21/06*** | (2006.01) |
| ***H01P 11/00*** | (2006.01) |

(52) U.S. Cl.

CPC ..... *H01Q 1/526* (2013.01); *H01P 11/00* (2013.01); *H01Q 1/38* (2013.01); *H01Q 1/523* (2013.01); *H01Q 3/26* (2013.01); *H01Q 21/0087* (2013.01); *H01Q 21/061* (2013.01); *Y10T 29/49016* (2015.01)

(58) Field of Classification Search

CPC .... H01Q 3/26; H01Q 21/0087; H01Q 1/526; H01Q 21/061

USPC ..... 343/770, 774, 776, 853, 893, 904

See application file for complete search history.

(56) References Cited

U.S. PATENT DOCUMENTS

| | | | | |
|---|---|---|---|---|
| 4,197,544 A * | 4/1980 | Kaloi | ..... | H01Q 9/0407 343/700 MS |
| 4,816,835 A * | 3/1989 | Abiko | ..... | H01Q 21/0075 343/700 MS |
| 5,276,455 A * | 1/1994 | Fitzsimmons | ..... | H01Q 21/0087 342/368 |

(Continued)

FOREIGN PATENT DOCUMENTS

| | | |
|---|---|---|
| EP | 2551959 A1 | 1/2013 |
| WO | 2010088133 A1 | 8/2010 |

OTHER PUBLICATIONS

Extended European Search Report for Application No. 13199120.0 dated Apr. 23, 2014, 6 pages.

*Primary Examiner* — Dameon E Levi
*Assistant Examiner* — Hasan Islam
(74) *Attorney, Agent, or Firm* — Toler Law Group, PC

(57) ABSTRACT

A method includes coupling a printed circuit board (PCB) and a first conductive sheet to a pressure plate to form an antenna sub-assembly. The first conductive sheet defines a first plurality of openings and includes a first plurality of bumps. At least one opening of the first plurality of openings is surrounded by a set of bumps of the first plurality of bumps. The method includes coupling the antenna sub-assembly to a cover to form an antenna assembly.

19 Claims, 6 Drawing Sheets

(56) References Cited

U.S. PATENT DOCUMENTS 5,444,453 A 8/1995 Lalezari
6,184,832 B1 * 2/2001 Geyh ..... H01Q 21/0087 343/700 MS
6,842,158 B2 * 1/2005 Jo ..... H01Q 1/243 343/700 MS
7,764,236 B2 * 7/2010 Hill ..... H01Q 1/243 343/702
8,081,134 B2 * 12/2011 Raby ..... H01Q 3/26 343/700 MS
2003/0184476 A1 * 10/2003 Sikina ..... H01Q 3/36 343/700 MS
2005/0017904 A1 * 1/2005 Navarro ..... H01Q 21/065 343/700 MS
2008/0316139 A1 * 12/2008 Blaser ..... H01Q 21/064 343/872
2009/0153426 A1 * 6/2009 Worl ..... H01Q 21/0075 343/776
2009/0284415 A1 11/2009 Worl et al.
2011/0234472 A1 9/2011 Maurer et al.
2012/0154238 A1 6/2012 Carpentier et al.

* cited by examiner

RADIO FREQUENCY GROUNDING SHEET FOR A PHASED ARRAY ANTENNA

FIELD

The present disclosure is generally related to phased array antennas.

BACKGROUND

Antenna arrays include a plurality of radiating elements which may be arranged on a printed circuit board (PCB). The area surrounding each of the plurality of radiating elements must be grounded to provide good ground continuity between assembly layers and to prevent radio frequency (RF) leakage (e.g., crosstalk) between radiating elements. As antenna arrays become increasingly smaller in size, it becomes more difficult to achieve operating frequencies in excess of fifteen (15) gigahertz (GHz). In particular, as the physical size of an antenna array becomes small, it becomes more difficult to ground the areas surrounding the radiating elements. The reduced physical size of the antenna arrays has resulted in an operating frequency plateau of approximately fifteen (15) GHz. Attempts to construct reduced size antenna arrays capable of operation at frequencies in excess of fifteen (15) GHz have failed due to an inability to reliably provide sufficient grounding contacts within the physical size limits of the reduced feature sizes of the antenna arrays, where the feature sizes of the components (e.g., the radiating elements, grounding contacts, etc.) of the antenna arrays are inversely proportional to the operating frequency.

SUMMARY

An antenna (e.g., a phased array antenna) is disclosed and includes a plurality of radio frequency (RF) elements arranged into a plurality of rows and columns. Each of the plurality of RF elements is disposed on a printed circuit board (PCB). During operation, the antenna is configured to operate at RF frequencies in excess of fifteen (15) gigahertz (GHz). To provide good connection between the antenna assembly layers and to prevent leakage (e.g., crosstalk) of RF signals (i.e., RF leakage) between adjacent RF elements, the antenna includes one or more grounding shims (e.g., conductive sheets) configured to create ground contacts around a perimeter of each of the RF elements disposed on the PCB. The one or more grounding shims may be made of a conductive material (e.g., Beryllium-Copper) and may define a plurality of openings. Each of the one or more grounding shims includes a plurality of bumps disposed on a surface of the grounding shim and one or more of the plurality of openings defined by a grounding shim may be surrounded by a set of the plurality of bumps.

When assembled, the one or more grounding shims may be positioned between the PCB and a cover of the antenna, between the PCB and a pressure plate of the antenna, or both. The grounding shims are configured to align with the PCB such that the each openings of the grounding shim corresponds to a particular RF element of the PCB. During use of the antenna, the sets of bumps surrounding the one or more openings function as ground contacts and reduce RF leakage (e.g., crosstalk) between adjacent RF elements. An antenna according to one or more of the embodiments described herein may be capable of transmitting and receiving RF signals at frequencies up to and in excess of fifty (50) gigahertz (GHz).

In an embodiment, an apparatus includes a cover including a plurality of waveguides, a pressure plate, a printed circuit board (PCB) including a plurality of radiating elements of an antenna array, and a first conductive sheet defining a first plurality of openings and including a first plurality of bumps. One or more openings of the first plurality of openings is surrounded by a set of bumps of the first plurality of bumps. The PCB and the first conductive sheet are positioned between the cover and the pressure plate.

In an embodiment, a method includes coupling a printed circuit board (PCB) and a first conductive sheet to a pressure plate to form an antenna sub-assembly. The cover includes a plurality of waveguides. The PCB includes a plurality of radiating elements of an antenna array. The first conductive sheet defines a first plurality of openings and includes a first plurality of bumps. At least one opening of the first plurality of openings is surrounded by a set of bumps of the first plurality of bumps. The method includes coupling the antenna sub-assembly to a cover to form an antenna assembly. The PCB and the first conductive sheet are positioned between the cover and the pressure plate.

In another embodiment, an apparatus includes a printed circuit board (PCB) including a plurality of radiating elements of an antenna array, an antenna array radiating aperture comprising a plurality of conductive waveguides, and a conductive sheet comprising a plurality of bumps. The conductive sheet is positioned between the PCB and the antenna array radiating aperture. During operation of the antenna array, the plurality of bumps function as a plurality of ground contacts of the antenna array.

In another embodiment, a method includes coupling at least one conductive sheet to an antenna array. The at least one conductive sheet includes a plurality of bumps, and, during operation of the antenna array, the plurality of bumps function as a plurality of ground contacts of the antenna array.

DETAILED DESCRIPTION

Figure 1:
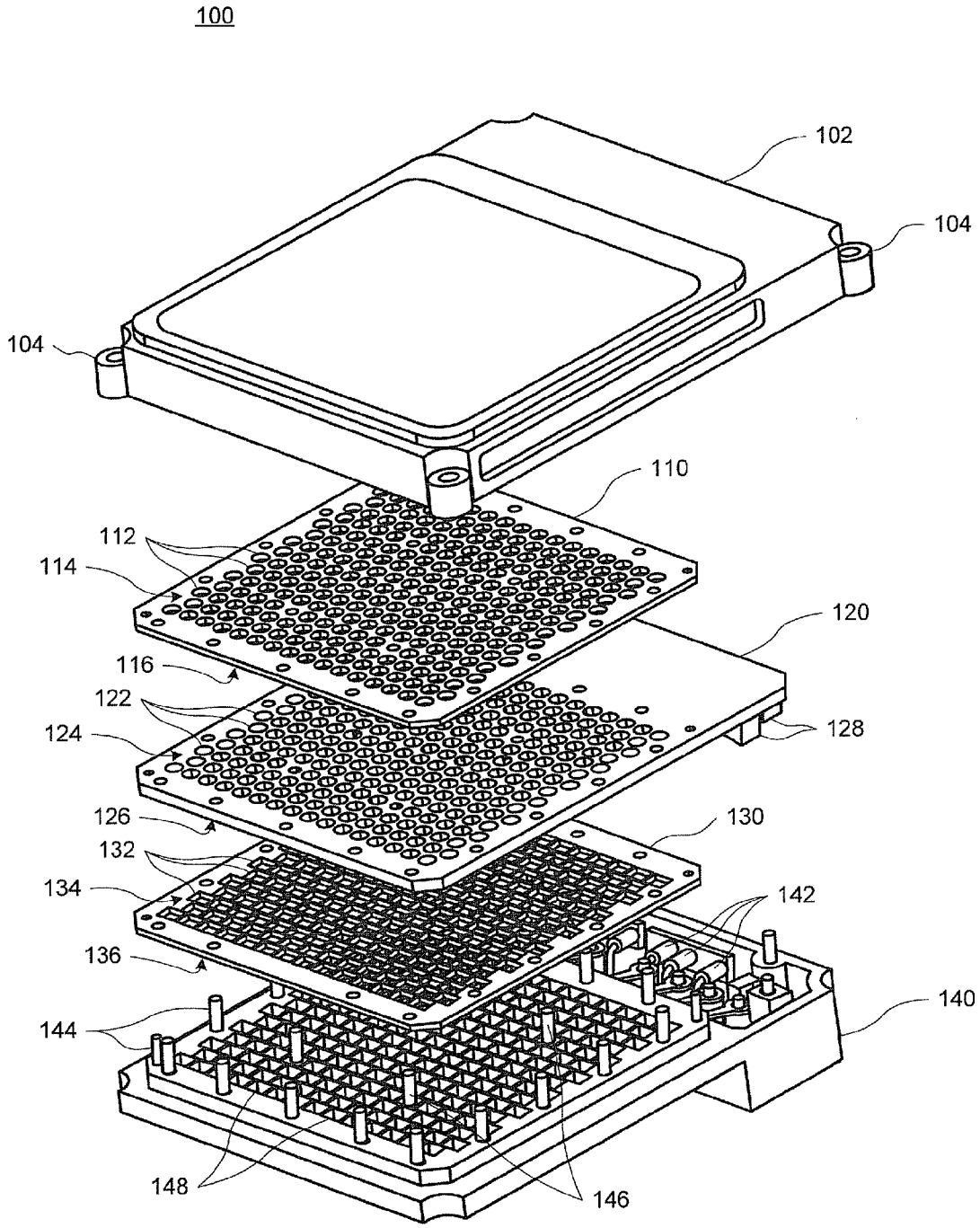
FIG. 1 is an illustrative embodiment of an antenna assembly.

Referring to FIG. 1, an illustrative embodiment of an apparatus 100 is shown. In an embodiment, the apparatus 100 is a phased array antenna configured to operate at frequencies up to, and in excess of fifty (50) gigahertz (GHz). As shown in FIG. 1, the apparatus 100 includes a cover 102, a first conductive sheet 110 (e.g., a first grounding shim), a printed circuit board (PCB) 120, a second conductive sheet 130 (e.g., a second grounding shim), and a pressure plate 140.

The PCB 120 includes a first surface 124 and a second surface 126. A plurality of radiating elements 122 of an antenna array may be disposed on the first surface 124 of the PCB 120. As shown in FIG. 1, the PCB 120 may include an electronic connector 128 (e.g., a ribbon connector). The PCB 120 may be multilayered PCB that includes a circuitry network that couples each of the radiating elements 122 to a high frequency integrated circuit (HF-IC) package and to the electronic connector 128. The packages (not shown) may be electrically coupled to connectors disposed on the second surface 126 of the PCB 120. The connectors disposed on the second surface 126 of the PCB 120 may couple each the plurality of HF-IC packages to a particular one of the radiating elements 122 via the circuitry network. The HF-IC packages may, in response to control signals received via the circuit network, cause the radiating elements 122 to transmit and/or receive RF signals. In a particular embodiment, the radiating elements 122 of the apparatus 100 may transmit and/or receive signals at a frequency up to, and in excess of fifty (50) gigahertz (GHz).

As shown in FIG. 1, the first conductive sheet 110 includes a first surface 114 and a second surface 116 that is opposite the first surface 114. The first conductive sheet 110 defines a first plurality of openings 112 and includes a first plurality of bumps. Each of the first plurality of openings 112 may define an area (e.g. an area of the opening) having a particular shape. The particular shape of the area defined by each of the first plurality of openings 112 may correspond to a shape of each of the plurality of radiating elements 122. When the first conductive sheet 110 is positioned between the PCB 120 and the cover 102 or the pressure plate 140, each of the first plurality of openings 112 may be aligned with one of the plurality of radiating elements 122. In an embodiment, each of the first plurality of openings 112 may define an area having a circular shape. In another embodiment, each of the first plurality of openings 112 may define an opening having another shape.

In an embodiment, the first plurality of bumps is disposed on the first surface 114 of the first conductive sheet 110. In another embodiment, the first plurality of bumps may be disposed on the second surface 116 of the first conductive sheet 110. One or more of the first plurality of openings 112 may be surrounded by a set of bumps of the first plurality of bumps. During use of the apparatus 100, the first plurality of bumps functions as ground contacts of the apparatus 100. The ground contacts (e.g., the first plurality of bumps) electrically isolate a corresponding one of the radiating elements 122 of the PCB 120 and reduce an amount of RF leakage (e.g., crosstalk) between adjacent radiating elements 122.

Figure 2:
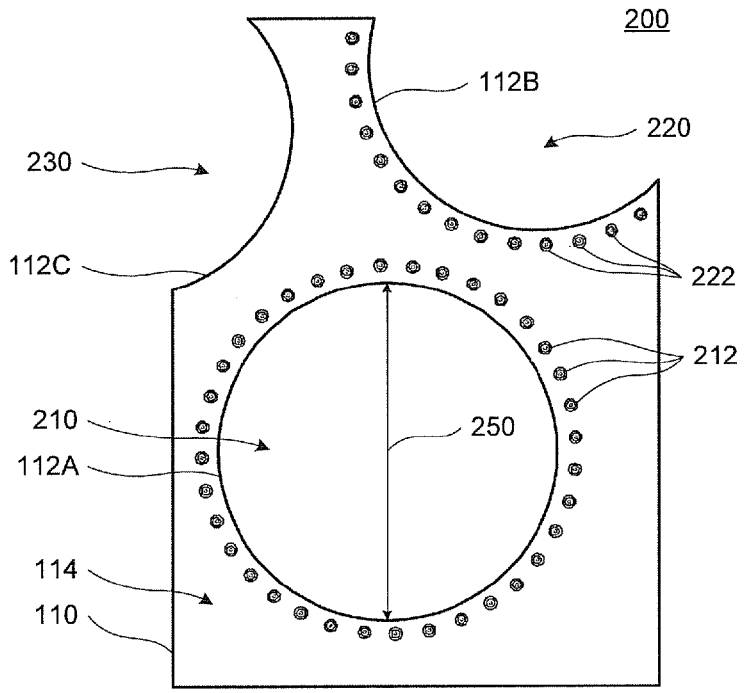
FIG. 2 is a diagram of a portion of a first surface of a first conductive sheet.

For example, referring to FIG. 2, a portion 200 of the first surface 114 of the first conductive sheet 110 is shown. As shown in FIG. 2, the portion 200 of the first conductive sheet 110 defines a first opening 112A. Portions of a second opening 112B and a third opening 112C are also shown. The first opening 112A may define a first area 210, the second opening 112B may define a second area 220, and the third opening 112C may define a third area 230. Each of the areas 210, 220, 230 may have a diameter. For example, the first area 210 has a diameter 250. In a particular embodiment, the diameter 250 may be selected to correspond to a size of a radiating element of the apparatus 100. For example, in a particular embodiment, the diameter 250 may be about two-hundred sixty-two (262) one-thousandths of an inch.

As shown in FIG. 2, the first opening 112A may be surrounded by a first set of bumps 212 of the first plurality of bumps, and the second opening 112B may be surrounded by a second set of bumps 222 of the first plurality of bumps. Although not illustrated in FIG. 2, the third opening 112C may also be surrounded by a set of bumps of the first plurality of bumps. In a particular embodiment, each of the first plurality of openings 112 of FIG. 1 may be surrounded by a set of bumps of the first plurality of bumps. Alternatively, a selected subset of openings of the first plurality of openings 112 may be surrounded by sets of bumps of the first plurality of bumps, where the subset of openings is selected to reduce RF leakage (e.g., crosstalk) between adjacent radiating elements of the plurality of radiating elements 122.

Ground contacts (e.g., the first plurality of bumps) between each of the first plurality of openings 112 may be sized in order to provide effective signal blocking (e.g., prevent RF leakage and cross-coupling between adjacent radiating elements based on a design frequency range of operation or based on a maximum design frequency). To illustrate, effective signal blocking may be achieved when each of the plurality of radiating elements 122 is surrounded by ground contacts (e.g., the first plurality of bumps) such that a distance between adjacent ground contacts (e.g., adjacent bumps of the first plurality of bumps) is approximately one-twentieth (1/20) of a wavelength apart. The wavelength corresponds to the shortest wavelength signal in the design frequency range. In a particular embodiment, the first plurality of bumps may be configured (e.g., sized and spaced) to provide effective RF ground contact and signal blocking between adjacent radiating elements of the apparatus 100 at a frequency range up to, and in excess of fifty (50) GHz. Specific dimensions of elements of the apparatus 100 described herein are examples of dimensions that may be used to enable operation of the apparatus 100 at a design frequency of fifty (50) GHz or more.

The first conductive sheet 110 and the first plurality of bumps provide a simple to manufacture, low cost solution for providing effective RF ground contact and signal blocking between radiating elements of antenna arrays configured to transmit and/or receive RF signals at frequencies up to, and in excess fifty (50) GHz. For example, the first conductive sheet 110 and the first plurality of bumps may be formed using a machining process, a mechanical punching process, a stamping process, an etching process, or a combination thereof. The size (e.g., a diameter, length, width, or height) and shape of each of the bumps of the first plurality of bumps may be determined based on the design frequency range of the apparatus 100. In an embodiment, each bump of the first plurality of bumps has a height of approximately two (2) one-thousandths of an inch relative to a surface (e.g., the first surface 114) of the first conductive sheet 110. In another embodiment, each of the first plurality of bumps has a height of approximately three (3) one-thousandths of an inch relative to a surface (e.g., the first surface 114) of the first conductive sheet 110. In another embodiment, each of the first plurality of bumps has a height of approximately four (4) one-thousandths of an inch relative to a surface (e.g., the first surface 114) of the first conductive sheet 110. In an embodiment, a base of each of the first plurality of bumps may have a diameter of approximately five (5) one-thousandths of an inch. In a particular embodiment, each bump of the first plurality of bumps has a domed shape. In another embodiment, each bump of the first plurality of bumps may have another shape.

Additionally, the spacing (i.e., the distance) between adjacent bumps may be selected to provide effective RF grounding and signal blocking (e.g., prevent RF leakage and cross-coupling between adjacent radiating elements) based on the design frequency range of the apparatus 100. For example, as illustrated in FIG. 2, each set of bumps surrounding the one or more openings of first plurality of openings 112 includes thirty-six (36) bumps; however, in other embodiments, each set of bumps surrounding the one or more openings of first plurality of openings 112 includes more than thirty-six (36) bumps or less than thirty-six (36) bumps. In an embodiment, a distance between a center of a particular bump of the first plurality of bumps and a center of an adjacent bump of the first plurality of bumps may be between eight (8) one-thousandths of an inch and ten (10) one-thousandths of an inch.

Thus, when the apparatus 100 includes the first conductive sheet 110 and the PCB 120 between the cover 102 and the pressure plate 140, the apparatus 100 may be configured to transmit and/or receive RF signals with reduced RF leakage at frequencies up to, and in excess of fifty (50) GHz. In a particular embodiment, when the apparatus 100 includes the first conductive sheet 110 and the PCB 120 between the cover 102 and the pressure plate 140, the apparatus 100 may be configured to transmit and/or receive RF signals with reduced RF leakage at frequencies up to, and in excess of fifty (50) GHz. Additionally, the first conductive sheet 110 provides a simple to manufacture, low cost solution for providing effective signal blocking in the apparatus 100.

In a particular embodiment, effective RF ground and RF leakage between adjacent radiating elements of the plurality of radiating elements 122 is reduced when the apparatus 100 includes the first conductive sheet 110 between cover 102 and the first surface 124 of the PCB 120. However, RF leakage between adjacent radiating elements may also occur through the second surface 126 of the PCB 120. Thus, in a particular embodiment, the apparatus 100 may include the second conductive sheet 130 to prevent or reduce an amount of RF leakage via the second surface 126 of the PCB 120.

As shown in FIG. 1, the second conductive sheet 130 (e.g., a second grounding shim) includes a first surface 134 and a second surface 136 that is opposite the first surface 134. The second conductive sheet 130 defines a second plurality of openings 132 and may include a second plurality of bumps. One or more of the second plurality of openings 132 may be surrounded by a set of bumps of the second plurality of bumps. In an embodiment, the second plurality of bumps is disposed on the first surface 134 of the second conductive sheet 130. In another embodiment, the first plurality of bumps is disposed on the second surface 136 of the second conductive sheet 130.

Figure 3:
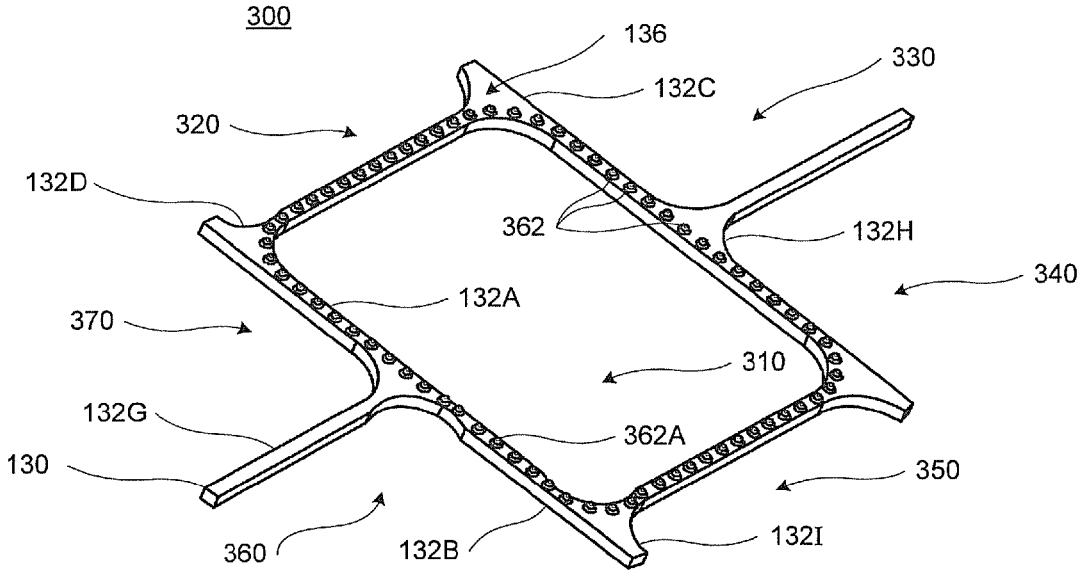
FIG. 3 is a diagram of a portion of a second surface of a second conductive sheet.

For example, referring to FIG. 3, a portion 300 of the second surface 136 of the second conductive sheet 130 is shown. As shown in FIG. 3, the portion 300 of the second conductive sheet 130 defines a first opening 132A. Portions of a second opening 132B, a third opening 132C, a fourth opening 132D, a fifth opening 132G, a sixth opening 132H, and a seventh opening 132I are also shown. The first opening 132A may define an area 310, the second opening 132B may define an area 360, the third opening 132C may define an area 330, the fourth opening 132C may define an area 320, a fifth opening 132G may define an area 370, the sixth opening 132H may define an area 340, and the seventh opening 132I may define an area 350. As shown in FIG. 3, the first opening 132A may be surrounded by a set of bumps 362 of the second plurality of bumps. Although not illustrated in FIG. 3, one or more of the second opening 132B, the third opening 132C, the fourth opening 132D, a fifth opening 132G, the sixth opening 132H, and the seventh opening 132I may also be surrounded by a set of bumps of the second plurality of bumps. In a particular embodiment, each of the second plurality of openings 132 of FIG. 1 may be surrounded by a set of bumps of the second plurality of bumps. Alternatively, a selected subset of openings of the second plurality of openings 132 may be surrounded by sets of bumps of the second plurality of bumps, where the subset of openings is selected to reduce RF leakage (e.g., crosstalk) between adjacent radiating elements of the plurality of radiating elements 122.

Ground contacts (e.g., the second plurality of bumps) between each of the second plurality of openings 132 may be sized to provide effective RF ground and signal blocking (e.g., prevent RF leakage and cross-coupling between adjacent radiating elements based on the design frequency range of operation or based on the maximum design frequency). In a particular embodiment, a distance between adjacent openings of the second plurality of openings 132 may be between seven (7) one-thousandths of an inch and ten (10) one-thousandths of an inch. As described with reference to FIG. 2, effective signal blocking may be achieved when each of the plurality of radiating elements 122 is surrounded by ground contacts (e.g., the first plurality of bumps) and each of the HF-IC packages is surrounded by ground contacts (e.g., the second plurality of bumps) such that a distance between adjacent ground contacts (e.g., adjacent bumps of the first plurality of bumps and adjacent bumps of the second plurality of bumps) is approximately one-twentieth (1/20) of a wavelength (e.g., the wavelength of the signal in the design frequency range) apart. For example, the second plurality of bumps may be configured (e.g., sized and spaced) to provide effective RF ground and signal blocking between adjacent radiating elements of the apparatus 100 at a frequency range up to, and in excess of fifty (50) GHz.

The second conductive sheet 130 and the second plurality of bumps provide a simple to manufacture, low cost solution for providing effective RF ground and signal blocking between radiating elements of antenna arrays configured to transmit and/or receive RF signals at frequencies up to, and in excess fifty (50) GHz. For example, the second conductive sheet 130 and the second plurality of bumps may be formed using a machining process, a mechanical punching process, a stamping process, an etching process, or a combination thereof. The size (e.g., a diameter, length, width, or height) and shape of each of the bumps of the second plurality of bumps may be determined based on the design frequency range of the apparatus 100. In an embodiment, each of the second plurality of bumps has a height relative to a surface (e.g., the second surface 136) of the second conductive sheet 130 between two (2) one-thousandths of an inch and four (4) one-thousandths of an inch. In an embodiment, a base of each of the second plurality of bumps may have a diameter of approximately five (5) one-thousandths of an inch. In a particular embodiment, each bump of the second plurality of bumps has a domed shape. In another embodiment, each bump of the second plurality of bumps may have another shape. In an embodiment, a shape of the second plurality of openings 132 may be determined based on a shape of the HF-IC packages coupled to the second surface 126 of the PCB 120, based on a shape of the plurality of recesses 148 defined by the pressure plate 140, or both.

Additionally, the spacing (i.e., the distance) between adjacent bumps may be selected to provide effective RF ground and signal blocking (e.g., prevent RF leakage and cross-coupling between adjacent radiating elements) based on the frequency range of the apparatus 100. For example, as illustrated in FIG. 3, each set of bumps (e.g., the set of bumps 362) surrounding the one or more openings of second plurality of openings 132 includes seventy (70) bumps. In another embodiment, each set of bumps surrounding the one or more openings of second plurality of openings 132 includes more than seventy (70) bumps or less than seventy (70) bumps. In an embodiment, a distance between a center of a particular bump of the second plurality of bumps and a center of an adjacent bump of the second plurality of bumps may be between eight (8) one-thousandths of an inch and ten (10) one-thousandths of an inch.

Thus, when the apparatus 100 includes the second conductive sheet 130 and the PCB 120 between the cover 102 and the pressure plate 140, the apparatus 100 may be configured to transmit and/or receive RF signals with effective RF ground and reduced RF leakage at frequencies up to, and in excess of fifty (50) GHz. In a particular embodiment, when the apparatus 100 includes the second conductive sheet 130 and the PCB 120 between the cover 102 and the pressure plate 140, the apparatus 100 may be configured to transmit and/or receive RF signals with effective RF ground and reduced RF leakage at frequencies up to, and in excess of fifty (50) GHz. Additionally, the second conductive sheet 130 provides a simple to manufacture, low cost solution for providing effective signal blocking in the apparatus 100.

In an embodiment, the first conductive sheet 110, the second conductive sheet 130, or both, are made of a conductive material (e.g., a metal or metal alloy). For example, first conductive sheet 110 and the second conductive sheet 130 may be formed of Beryllium-Copper. In an embodiment, the first conductive sheet 110, the second conductive sheet 130, or both, may be treated to have a conductive surface. For example, first conductive sheet 110, the second conductive sheet 130, or both, may be gold plated. The gold plating may have a thickness between fifty (50) microns and seventy (70) microns. In a particular embodiment, the first conductive sheet 110, the second conductive sheet 130, or both, may be plated with Nickel before the gold plating is applied. The Nickel plating may have a thickness between fifty (50) micro-inches and two-hundred (200) micro-inches.

In a particular embodiment, a particular set of bumps surrounding a particular opening may include at least one bump in common with another set of bumps surrounding another opening that is adjacent to the particular openings. To illustrate, referring to FIG. 3, the set of bumps 362 surrounding the first opening 132A and a set of bumps (not shown) surrounding an adjacent opening (e.g., the second opening 132B) may include at least one common bump, such as the bump 362A. In another particular embodiment, each set of bumps of the first plurality of bumps or the second plurality of bumps may not include a common bump. To illustrate, referring to FIG. 2, the first opening 112A and the second opening 112B do not share any bumps in common.

Referring to FIG. 1, the pressure plate 140 includes a plurality of connectors (e.g., screws, bolts, posts, etc.). As shown in FIG. 1, the plurality of connectors includes a plurality of peripheral connectors 144 and a plurality of internal connectors 146. The plurality of peripheral connectors 144 may be located proximate a periphery of the pressure plate 140, and the plurality of internal connectors 146 may be proximate a central portion of the pressure plate 140, as shown in FIG. 1. Each of the plurality of connectors is configured to extend through a particular connector opening of a plurality of connector opening defined by the first conductive sheet 110, the PCB 120, and the second conductive sheet 130. One or more of the plurality of connectors may be received at a corresponding connector receptacle. In an embodiment, the connector receptacles may be disposed on a bottom surface of the cover 102. In a particular embodiment, the pressure plate 140 may include one or more alignment pins (not shown) configured to mechanically align the components (e.g., the first conductive sheet 110, the PCB 120, and the second conductive sheet 130) between the cover 102 and the pressure plate 140.

As shown in FIG. 1, the pressure plate 140 defines a plurality of recesses 148. In a particular embodiment, each of the plurality of recesses 148 may be configured to receive a spring-loaded assembly (not shown). The spring-loaded assemblies may be configured to apply pressure to the HF-IC packages coupled to the second surface 126 of the PCB 120. The pressure applied to the HF-IC packages by the spring-loaded assemblies may improve the electrical connection between the HF-IC packages and the connectors on the second surface 126 of the PCB 120. In a particular embodiment, the HF-IC packages may extend through the second plurality of openings 132 and into the plurality of recesses 148 of the pressure plate. In this embodiment, each of the plurality of spring-loaded assemblies contacts a particular one of the HF-IC packages when the particular HF-IC package is within one of the recesses 148 and maintains the particular HF-IC package in spring-loaded contact with a particular connector on the second surface 126 of the PCB 120. The plurality of connectors may be tightened or loosened to adjust the spring loaded contact of one or more of the HF-IC packages and a corresponding particular connector on the second surface 126 of the PCB 120.

The plurality of connectors (e.g., the periphery connectors 144 and the internal connectors 146) may be tightened or loosened to adjust spring-loaded force between the pressure plate 140 and the cover 102. The spring-loaded force generated by the tightening of the plurality of connectors secures the first conductive sheet 110, the PCB 120, and the second conductive sheet 130 between the pressure plate 140 and the cover 102.

Additionally, during use, the apparatus 100 may generate heat, causing thermal expansion and/or thermal contraction of one or more of the components. The plurality of connectors is designed to generate constant pressure on the antenna assembly over a range of environmental changes (e.g., temperature). The constant pressure keeps the first plurality of bumps of the first conductive sheet 110 and the second plurality of bumps of the second conductive sheet 130 under constant pressure to secure ground contacts, as described with reference to FIG. 8.

As shown in FIG. 1, the pressure plate 140 may include electronics 142. The electronics 142 may include a connector configured to couple the electronics 142 to the electronic connector 128 of the PCB 120. The electronics 142 may include a connection to an external source (e.g., a power supply) and provide power to the apparatus 100 (e.g., provide power to the components of the PCB 120). In a particular embodiment, the electronics 142 may couple the apparatus 100 to an external device (e.g., a computer or a processor). Control signals may be received from the external device via the electronics 142 and the control signals may be provided to the PCB 120 via the electronic connector 128 coupled to the electronics 142. The control signals may cause one or more of the plurality of radiating elements 122 to transmit or receive RF signals. When signals are received at one or more of the plurality of radiating elements 122, signal data descriptive of the received signals may be communicated to the electronics 142 via the electronic connector 128 and the electronics 142 may communicate the signal data to the external device.

Thus, an antenna array, such as the apparatus 100, that includes the first conductive sheet 110, the second conductive sheet 130, or both, may be configured to transmit and/or receive RF signals at frequencies up to, and in excess of fifty (50) GHz while providing RF ground and reducing an amount of RF leakage (e.g., cross talk) between radiating elements of the antenna array. Additionally, due to the low costs methods for producing (e.g., using a stamping process) the first conductive sheet 110 and the second conductive sheet 130, an antenna, such as the apparatus 100, may be manufactured at reduced cost.

Figure 4:
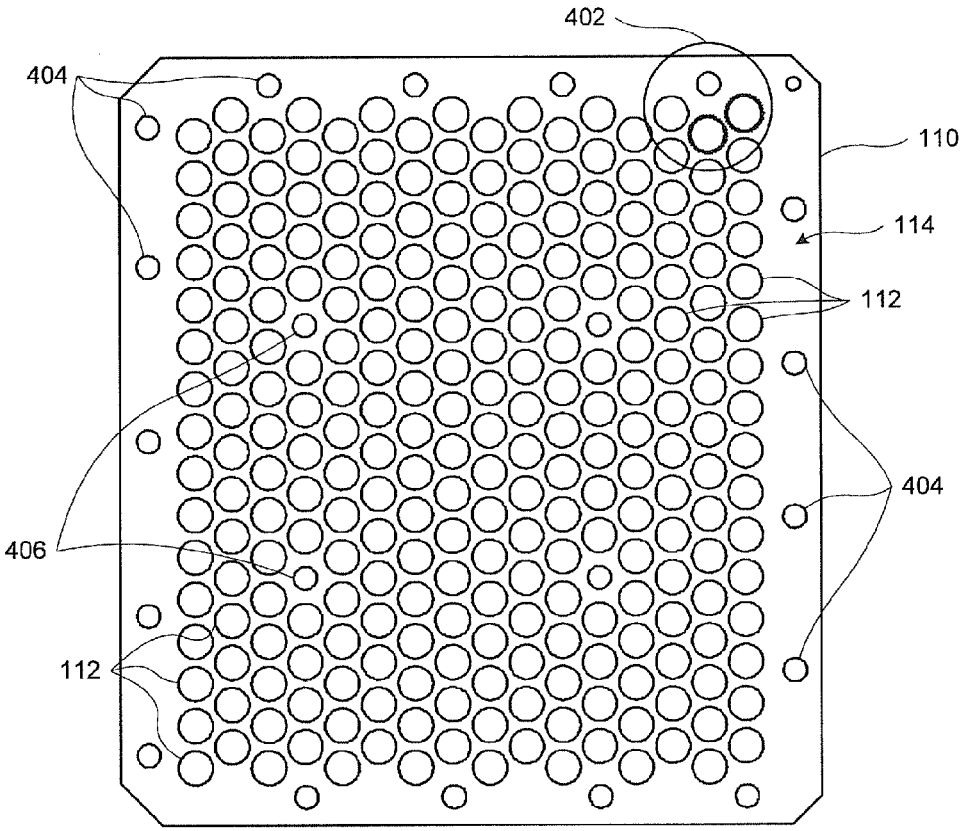
FIG. 4 is a diagram of a first conductive sheet.

Referring to FIG. 4, the first conductive sheet 110 of FIG. 1 is shown in more detail. As shown in FIG. 4, the first conductive sheet 110 defines a first plurality of openings 112 and includes a plurality of periphery connector openings 404 and a plurality of internal connector openings 406. The plurality of periphery connector openings 404 and the plurality of internal connector openings 406 may be configured to enable a plurality of connectors (e.g., the periphery connectors 144 and internal connectors 146 of FIG. 1) to extend through the first conductive sheet 110.

Figure 5:
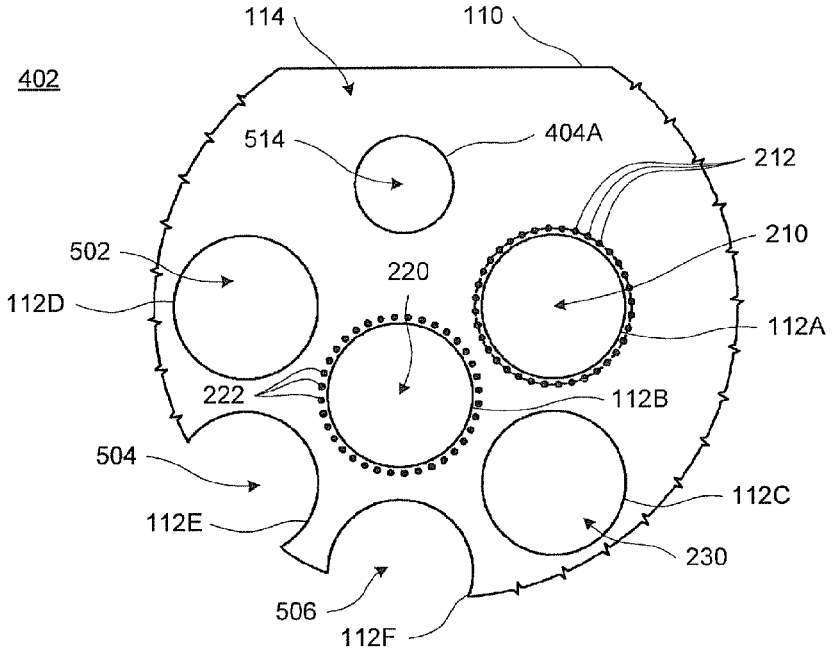
FIG. 5 is a diagram of a portion of a first surface of the first conductive sheet of FIG. 4.

One or more of the first plurality of openings 112 is surrounded by a set of bumps of the first plurality of bumps. For example, referring to FIG. 5, a portion 402 of the first surface 114 of the first conductive sheet 110 is shown. In FIG. 5, the portion of the first surface 114 of the first conductive sheet 110 includes the first opening 112A that defines the first area 210, the second opening 112B that defines the second area 220, the third opening 112C that defines the third area 230, a fourth opening 112D that defines a fourth area 502. Portions of a fifth opening 112E that defines a fifth area 504 and a sixth opening 112F that defines a sixth area 506 are also shown. As shown in FIG. 5, the portion 402 of the first surface 114 of the first conductive sheet 110 includes a periphery connector opening 404A that defines an area 514.

In a particular embodiment, the cover 102 may include mechanical mounts 104. The mechanical mounts 104 may be configured to receive mounting bolts (not shown) or another form of connector that enables the apparatus 100 to be mounted on a structure (e.g., an aircraft, a land-based vehicle, a sea craft, a building, etc.). In a particular embodiment, the mechanical mounts 104 may be used to couple the apparatus 100 to one or more other devices (e.g., another apparatus 100).

As shown in FIG. 5, the first opening 112A is surrounded by the first set of bumps 212 and the second opening 112B is surrounded by the second set of bumps 222. Although not illustrated in FIG. 5, the openings 112C-112F may also be surrounded by a set of bumps of the second plurality of bumps. In a particular embodiment, each of the first plurality of openings 112 of FIG. 1 may be surrounded by a set of bumps of the first plurality of bumps. Alternatively, a selected subset of openings of the first plurality of openings 112 may be surrounded by sets of bumps of the first plurality of bumps, where the subset of openings is selected to reduce RF leakage (e.g., crosstalk) between adjacent radiating elements of the plurality of radiating elements 122. The connector opening 404A may not be surrounded by a set of bumps of the first plurality of bumps because the bumps would not reduce RF leakage between the radiating elements 122 of the apparatus 100.

Figure 6:
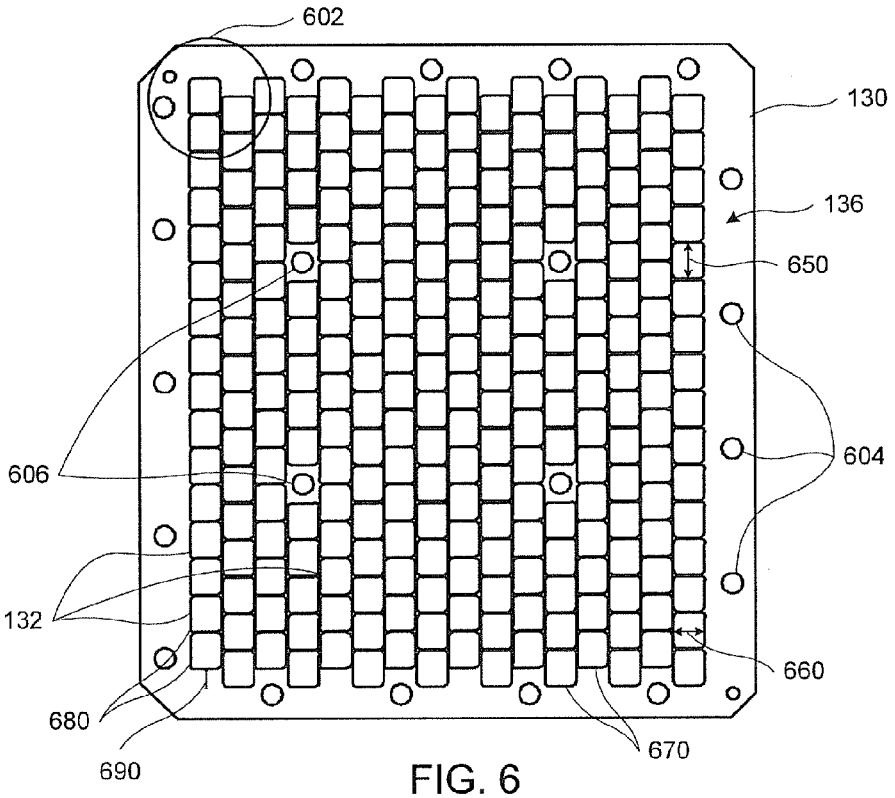
FIG. 6 is a diagram of a second conductive sheet.

Referring to FIG. 6, the second conductive sheet 130 of FIG. 1 is shown in more detail. As shown in FIG. 6, the second conductive sheet 130 defines a second plurality of openings 132 and includes a plurality of periphery connector openings 604 and a plurality of internal connector openings 606. The plurality of periphery connector openings 604 and the plurality of internal connector openings 606 may be configured to enable a plurality of connectors (e.g., the periphery connectors 144 and internal connectors 146 of FIG. 1) to extend through the second conductive sheet 130.

Figure 7:
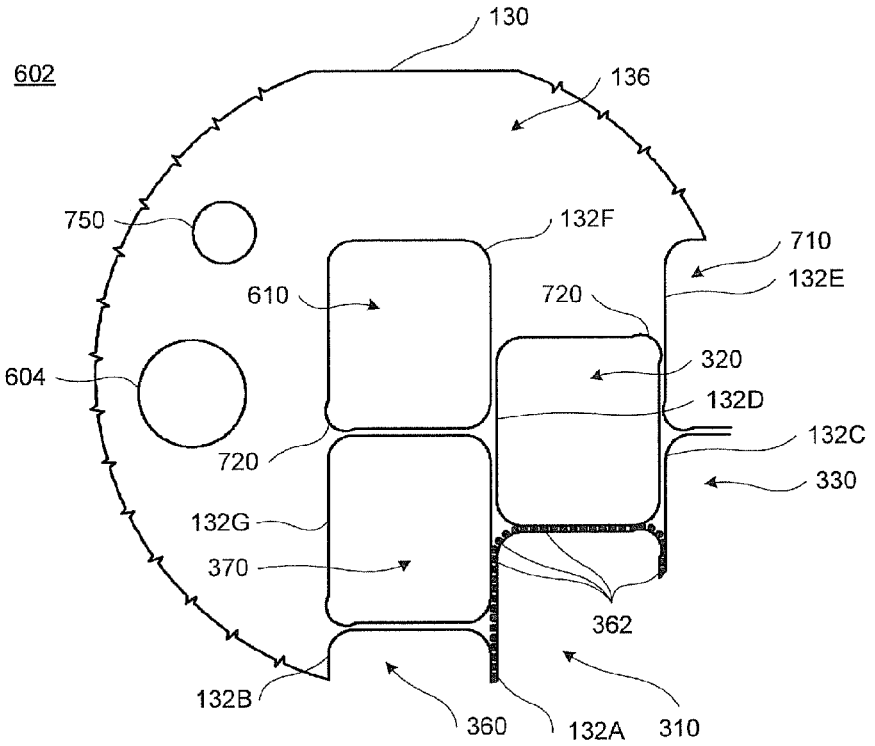
FIG. 7 is a diagram of a portion of a second surface of the second conductive sheet of FIG. 6.

One or more of the second plurality of openings 132 is surrounded by a set of bumps (e.g., the set of bumps 362) of the second plurality of bumps. For example, referring to FIG. 7, a portion 602 of the first surface 136 of the second conductive sheet 130 of FIG. 6 is shown. As shown in FIG. 7, the portion 602 of the first surface 136 of the second conductive sheet defines the fourth opening 132D that defines the fourth area 320, the fifth opening 132G that defines the fifth area 370, and a ninth opening 132F that defines a ninth area 610. Portions of the first opening 132A that defines the first area 310, the second opening 132B that defines the second area 360, the third opening 132C that defines the third area 330, and an eighth opening 132E that defines an eighth area 710. As shown in FIG. 7, the portion 602 of the second surface 136 of the second conductive sheet 130 includes a periphery connector opening 604 and a periphery alignment opening 750. The periphery connector opening 604 may be configured to enable a periphery connector (e.g., one of the periphery connectors 144) to pass through the second conductive sheet 130 and the periphery alignment opening 750 may be configured to enable an alignment pin (not shown) to pass through the second conductive sheet 130.

As shown in FIG. 7, the second opening 132B is surrounded by the set of bumps 362. Sets of bumps of the second plurality of bumps surrounding each of the openings 132A, 132C, 132D, 132E, 132F, and 132G and have been omitted from FIGS. 6 and 7 for simplicity of illustration. As shown in FIGS. 6 and 7, each of the second plurality of openings 132 has a generally rectangular shape. In a particular embodiment, one or more corners of the rectangular shape may be rounded. In a particular embodiment, one or more of the second plurality of openings 132 may include a keyed portion 720 (e.g., a notch). Each of the keyed portions 720 is configured to mechanically align a particular opening of the second plurality of openings 132 with a particular portion of the PCB 120. In an embodiment, one or more of the second plurality of openings 132 may have a shape that is different from the rectangular shape shown in FIGS. 1, 6, and 7. For example, when the HF-IC packages are to extend through the second plurality of openings 132, the second plurality of openings 132 may be configured according to a size or a shape of the HF-IC packages.

As shown in FIG. 6, the second plurality of openings 132 may be arranged in a plurality of columns 670 and a plurality of rows 680. In a particular embodiment, a particular column 670 may be offset relative to an adjacent column 670 by a distance 690. In a particular embodiment, the plurality of columns 670 includes sixteen (16) columns and the plurality of rows 680 includes sixteen (16) rows. In a particular embodiment, the second plurality of openings 132 includes two-hundred fifty-two (252) openings. In another particular embodiment, the second conductive sheet 130 may not include the four (4) internal connector openings 606 and the second plurality of openings 132 may include two-hundred fifty-six (256) openings.

Figure 8:
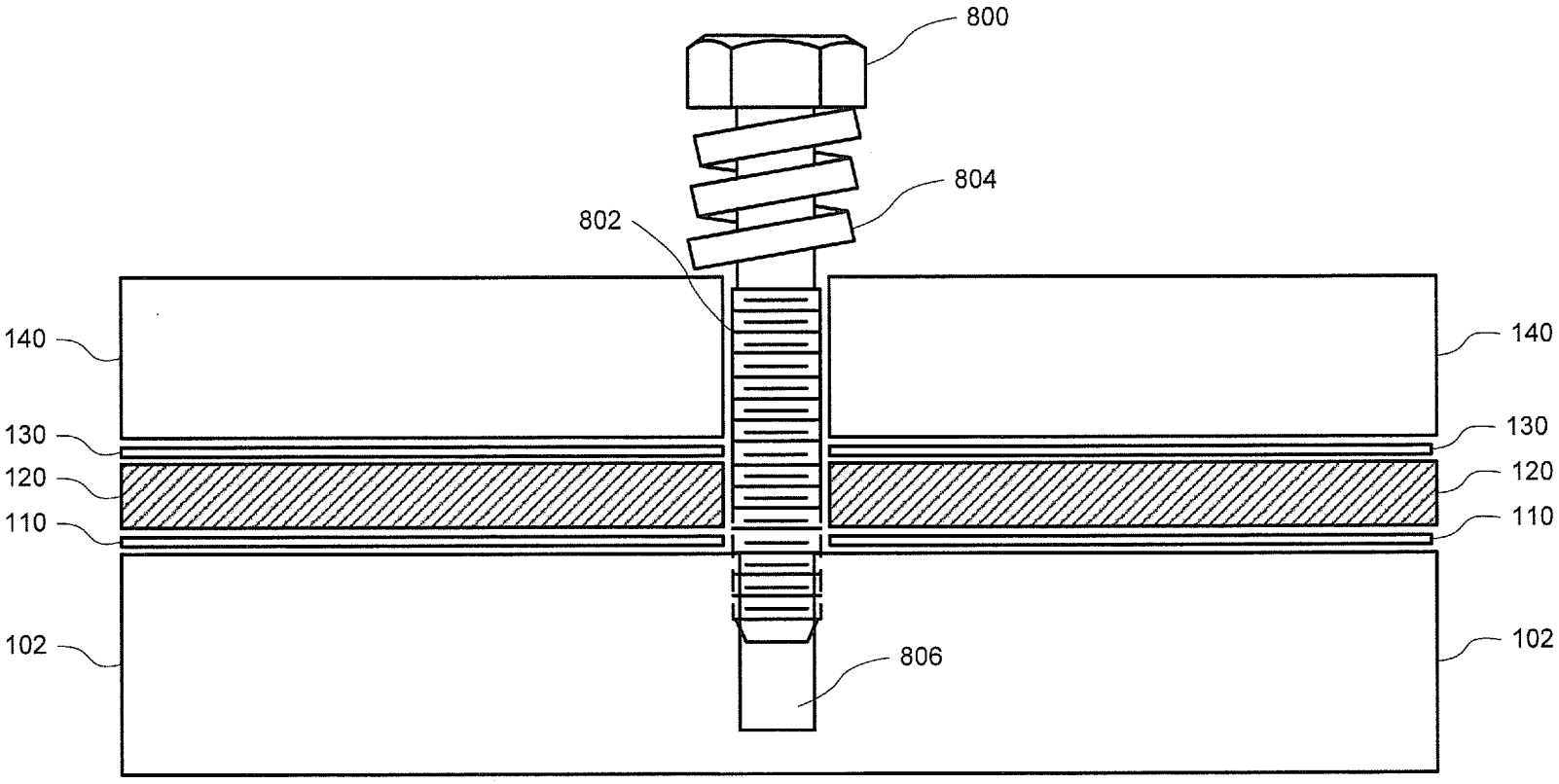
FIG. 8 is a cross section of a particular embodiment of the antenna assembly of FIG. 1.

Referring to FIG. 8, a cross section of a particular embodiment of the antenna assembly of FIG. 1 is shown. As shown in FIG. 8, the antenna assembly includes the cover 102, the first conductive sheet 110, the printed circuit board (PCB) 120, the second conductive sheet 130, and the pressure plate 140. The cross section of FIG. 8 also illustrates a connector 800 (i.e., one of the plurality of connectors of FIG. 1) extending through the pressure plate 140, the first conductive sheet 110, the printed circuit board (PCB) 120, the second conductive sheet 130, and into the cover 102. The cover 102 includes a connector receptacle 806 configured to receive a threaded portion 802 of the connector 800 when the connector 800 is tightened.

When the connector 800 is tightened (i.e., secured to the connector receptacle 806), the connector 800 secures the first conductive sheet 110, the PCB 120, and the second conductive sheet 130 between the cover 102 and the pressure plate 140. Additionally, the tightening of the connector 800 applies clamping pressure to the antenna assembly. The clamping pressure applied by the connector 800 causes a portion of the first plurality of bumps of first conductive sheet 110 and a portion of the second plurality of bumps of the second conductive sheet 130 to maintain grounding of the plurality of radiating elements (e.g., the plurality of radiating elements 122) of the PCB 120. The portion of the first plurality of bumps corresponds to an area of the first conductive sheet that is proximate a connector opening (e.g., a periphery connector opening 404 or an internal connector opening 406) through which the connector 800 is extended. The portion of the second plurality of bumps corresponds to an area of the second conductive sheet that is proximate a connector opening (e.g., a periphery connector opening 604 or an internal connector opening 606) through which the connector 800 is extended. Thus, the plurality of connectors may include a number of connectors (e.g., the connector 800) such that the clamping pressure is applied across the entire antenna assembly. When the clamping pressure is applied across the entire antenna assembly, each set of bumps in the first plurality of bumps and the second plurality of bumps provides radio frequency (RF) grounding and reduces an amount of RF leakage (e.g., cross talk) between adjacent radiating elements of the PCB 120 during use of the antenna assembly.

In a particular embodiment, the connector 800 includes a spring 804. The spring 804 is configured to maintain force (e.g., an amount of pressure) applied by the connector 800 at constant level during environmental changes (e.g., changes in temperature). For example, use of the antenna assembly may generate heat, causing thermal expansion of one or more of the components of the antenna assembly. The spring 804 causes the force applied to the components of the antenna assembly (e.g., the first conductive sheet, the PCB, and/or the second conductive sheet) to be relatively constant despite thermal expansion of the one or more of the components, enabling each set of bumps in the first plurality of bumps and the second plurality of bumps to provide RF grounding and to reduce RF leakage (e.g., cross talk) between adjacent radiating elements of the PCB 120 during use of the antenna assembly.

Figure 9:
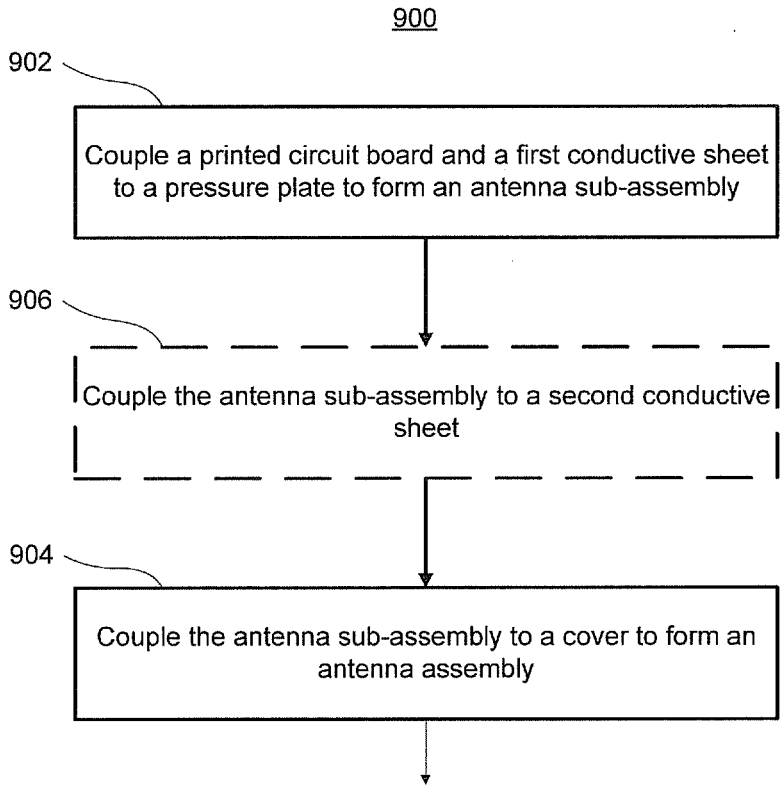
FIG. 9 is a flowchart of an embodiment of a method of assembling an antenna array.

Referring to FIG. 9, a method 900 of assembling an antenna array is shown. At 902, the method 900 includes coupling a printed circuit board (PCB) and a first conductive sheet to a pressure plate to form an antenna sub-assembly. The PCB includes a plurality of radiating elements of an antenna array. The first conductive sheet defines a first plurality of openings and includes a first plurality of bumps. At least one opening of the first plurality of openings is surrounded by a set of bumps of the first plurality of bumps. The first plurality of bumps may be located on a first surface of the first conductive sheet of the antenna assembly. In a particular embodiment, the PCB corresponds to the PCB 120 of FIG. 1. In an embodiment, the first conductive sheet corresponds to the first conductive sheet 110 of FIG. 1. In another embodiment, the first conductive sheet corresponds to the second conductive sheet 130 of FIG. 1.

At 904, the method 900 includes coupling the antenna sub-assembly to a cover to form an antenna assembly. The PCB and the first conductive sheet are positioned between the cover and the pressure plate. The cover includes plurality of waveguides. In a particular embodiment, the cover corresponds to the cover 102 of FIG. 1. In a particular embodiment, the cover 102 may correspond to an antenna radiating aperture comprising a plurality of conductive waveguides. In a particular embodiment, the plurality of conductive waveguides may be arranged in a honeycomb configuration.

In an embodiment, the method 900 includes, at 906, coupling the antenna sub-assembly to a second conductive sheet. Coupling the antenna sub-assembly to the second conductive sheet may be performed prior to coupling the antenna sub-assembly to the cover to form the antenna assembly. The second conductive sheet defines a second plurality of openings and includes a second plurality of bumps. At least one opening of the second plurality of openings is surrounded by a set of bumps of the second plurality of bumps. The second plurality of bumps may be located on a first surface of the second conductive sheet of the antenna assembly. In this embodiment, the PCB, the first conductive sheet, and the second conductive sheet are positioned between the cover and the pressure plate. In an embodiment, the second conductive sheet corresponds to the first conductive sheet 110 of FIG. 1. In another embodiment, the second conductive sheet corresponds to the second conductive sheet 130 of FIG. 1.

The antenna assembly, during use, is configured to transmit and/or receive signals at a frequency up to, and in excess of fifty (50) gigahertz (GHz). During use of the antenna assembly, each set of bumps of the first plurality of bumps functions as ground contacts of the antenna assembly. During operation, the ground contacts (e.g., each set of bumps surrounding one of the openings defined by the first conductive sheet) electrically isolate a corresponding one of the radiating elements of the PCB from an adjacent radiating element. When the antenna assembly includes the second conductive sheet that includes the second plurality of bumps, each set of bumps of the second plurality of bumps function as ground contacts of the antenna assembly. During operation, the ground contacts (e.g., each set of bumps surrounding one of the openings defined by the second conductive sheet) electrically isolate a corresponding one of the radiating elements of the PCB.

By coupling the first conductive sheet and/or the second conductive sheet to the PCB between the cover and the pressure plate, the first plurality of bumps and/or the second plurality of bumps provide improved grounding and electrical isolation of the radiating elements of the PCB. Additionally, the first conductive sheet and/or the second conductive sheet are able to flex to accommodate thermal expansion and thermal contraction of the elements of the antenna assembly without losing grounding and electrical isolation of the radiating elements. Additionally, the elements of an antenna assembly assembled using the method 900 may flex (e.g., shift or bend) due to the forces generated when the pressure plate is coupled to the cover. The first plurality of bumps and/or the second plurality of bumps are configured to maintain contact (e.g., maintain grounding and electrical isolation of the radiating elements) with the PCB, the cover, and/or the pressure plate when the elements of the antenna assembly flex. Further, the plurality of connectors apply clamping pressure across the entire antenna assembly, enabling each set of bumps in the first plurality of bumps and the second plurality of bumps to provide radio frequency (RF) grounding and to reduce an amount of RF leakage (e.g., cross talk) between adjacent radiating elements of the PCB 120 during use of the antenna assembly.

Thus, an antenna assembly assembled using the method 900 has good RF ground contacts between each of the antenna assembly layers and reduces the amount of cross-coupling, the amount of radio-frequency (RF) leakage, and cross-talk between each of the radiating elements of the PCB, resulting in improved performance of the antenna assembly. Additionally, an antenna array according to one or more of the embodiments described herein may be manufactured and assembled at a reduced cost due to the simplicity of manufacturing the conductive sheet(s) (e.g., the first conductive sheet 110, the second conductive sheet 130, or both). For example, the conductive sheet(s) may be manufactured using a machining process, a mechanical punching process, a stamping process, an etching process, or a combination thereof.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the illustrations or one or more method steps may be omitted. Accordingly, the disclosure and the figures are to be regarded as illustrative rather than restrictive.

Moreover, although specific embodiments have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments and other embodiments not specifically described herein will be apparent to those of skill in the art upon reviewing the description.

In the foregoing Detailed Description, various features may have been grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. An apparatus comprising:

a cover including a plurality of waveguides;

a pressure plate;

a printed circuit board (PCB) comprising a plurality of radiating elements of a phased array antenna;

a first conductive sheet defining a first plurality of openings and including a first plurality of bumps, wherein one or more openings of the first plurality of openings is surrounded by a set of bumps of the first plurality of bumps; and a second conductive sheet defining a second plurality of openings and including a second plurality of bumps, wherein one or more openings of the second plurality of openings is surrounded by a set of bumps of the second plurality of bumps, wherein the PCB is positioned between the first conductive sheet and the second conductive sheet, wherein the PCB, the first conductive sheet, and the second conductive sheet are positioned between the cover and the pressure plate, and wherein, the first plurality of bumps and the second plurality of bumps are constructed from a conductive material to function as ground contacts for the phased array antenna.

2. The apparatus of claim 1, wherein each of the first plurality of openings has a circular shape and wherein each of the second plurality of openings has a rectangular shape.

3. The apparatus of claim 1, further comprising at least one periphery connector located proximate a periphery of the pressure plate and at least one internal connector located proximate to a central portion of the pressure plate.

4. The apparatus of claim 3, wherein one or more of the at least one periphery connector and the at least one internal connector comprise a spring configured to maintain an amount of pressure applied to the first conductive sheet, the second conductive sheet, and the PCB.

5. The apparatus of claim 1, wherein a first particular opening of the first plurality of openings is in alignment with a particular radiating element of the PCB.

6. The apparatus of claim 1, wherein the first plurality of bumps is located on a first surface of the first conductive sheet and wherein the second plurality of bumps is located on a first surface of the second conductive sheet.

7. The apparatus of claim 6, wherein a first surface of the PCB is adjacent to a second surface of the first conductive sheet, wherein the second surface of the first conductive sheet is opposite the first surface of the first conductive sheet, wherein a second surface of the PCB is adjacent to a second surface of the second conductive sheet, wherein the second surface of the second conductive sheet is opposite the first surface of the second conductive sheet, and wherein the first surface of the PCB is opposite the second surface of the PCB.

8. The apparatus of claim 1, wherein each of the first conductive sheet, the PCB, and the second conductive sheet define a plurality of connector openings.

9. The apparatus of claim 8, wherein the pressure plate includes a plurality of connectors, each connector of the plurality of connectors configured to extend through a particular connector opening of the plurality of connector openings on the first conductive sheet, the PCB, and the second conductive sheet.

10. The apparatus of claim 1, wherein the pressure plate comprises a plurality of connectors around a periphery of the pressure plate, where the connectors can be tightened or loosened to adjust spring-loaded contact between first electronics coupled to the pressure plate and second electronics coupled to the plurality of radiating elements of the PCB.

11. The apparatus of claim 1, wherein the first plurality of bumps and the second plurality of bumps are sized according to a design frequency range.

12. The apparatus of claim 1, wherein the first plurality of bumps and the second plurality of bumps are shaped according to a design frequency range.

13. The apparatus of claim 1, wherein a distance between adjacent bumps of any of the first plurality of bumps and the second plurality of bumps is sized to correspond to shortest wavelength signal at a frequency of at least 15 GHz.

14. The apparatus of claim 1, wherein each set of bumps surrounding one or more openings defined by any of the first conductive sheet and the second conductive sheet electrically isolates a corresponding radiating element of the PCB from an adjacent radiating element.

15. A method comprising:

coupling a printed circuit board (PCB), a first conductive sheet, and a second conductive sheet to a pressure plate to form a phased array antenna sub-assembly; and coupling the phased array antenna sub-assembly to a cover to form a phased array antenna assembly, wherein the PCB comprises a plurality of radiating elements of the phased array antenna, wherein the PCB is positioned between the first conductive sheet and the second conductive sheet, wherein the first conductive sheet defines a first plurality of openings and includes a first plurality of bumps, wherein at least one opening of the first plurality of openings is surrounded by a set of bumps of the first plurality of bumps, wherein the second conductive sheet defines a second plurality of openings and includes a second plurality of bumps, wherein at least one opening of the second plurality of openings is surrounded by a set of bumps of the second plurality of bumps, wherein, the first plurality of bumps and the second plurality of bumps are constructed from a conductive material to function as ground contacts for the phased array antenna, and wherein the PCB, the first conductive sheet, and the second conductive sheet are positioned between the cover and the pressure plate.

16. The method of claim 15, wherein a distance between a particular bump of the first plurality of bumps and an adjacent bump of the first plurality of bumps is less than ten one-thousandths of an inch.

17. The method of claim 15, wherein the first plurality of bumps is located on a first surface of the first conductive sheet, wherein the second plurality of bumps is located on a first surface of the second conductive sheet, wherein a first surface of the PCB is adjacent to a second surface of the first conductive sheet, wherein the second surface of the first conductive sheet is opposite the first surface of the first conductive sheet, wherein a second surface of the PCB is adjacent to a second surface of the second conductive sheet, wherein the second surface of the second conductive sheet is opposite the first surface of the second conductive sheet, and wherein the first surface of the PCB is opposite the second surface of the PCB.

18. The method of claim 17, wherein the first plurality of bumps is adjacent to the cover and wherein the second plurality of bumps is adjacent to the pressure plate.

19. The method of claim 15, wherein the first plurality of bumps is formed using at least one of a machining process, a mechanical punching process, a stamping process, and an etching process.

* * * * *